US006878887B2

(12) United States Patent
Amano et al.

(10) Patent No.: US 6,878,887 B2
(45) Date of Patent: Apr. 12, 2005

(54) ANTI-MALFUNCTION MECHANISM FOR VARIABLE OUTPUT DEVICE

(75) Inventors: Futoshi Amano, Osaka (JP); Takamitsu Kouchi, Osaka (JP); Hisao Kobayashi, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 52 days.

(21) Appl. No.: 10/633,039

(22) Filed: Aug. 4, 2003

(65) Prior Publication Data

US 2004/0022534 A1 Feb. 5, 2004

(30) Foreign Application Priority Data

Aug. 7, 2002 (JP) ..... P2002-229769

(51) Int. Cl.[7] ..... H01H 19/00
(52) U.S. Cl. ..... 200/19.18; 200/566; 200/336
(58) Field of Search ..... 200/19.18, 564, 200/565, 566, 570, 336

(56) References Cited

U.S. PATENT DOCUMENTS 2,377,250 A * 5/1945 Lawson ..... 200/538
4,334,132 A * 6/1982 Poole ..... 200/566
5,384,442 A * 1/1995 Danner ..... 200/566
5,669,489 A * 9/1997 von Ende ..... 200/570
5,967,301 A * 10/1999 Reed et al. ..... 200/523
6,281,453 B1 * 8/2001 Uleski ..... 200/4

FOREIGN PATENT DOCUMENTS

JP 10-22108 1/1998

* cited by examiner

*Primary Examiner*—Kyung Lee
(74) *Attorney, Agent, or Firm*—McDermott Will & Emery LLP

(57) ABSTRACT

A variable output device is mounted on a mounting unit with the operating shaft displaceable. An operating unit for transmitting the operation of the user to the operating shaft is mounted on the operating shaft relatively movably along the direction of the axis of the operating shaft, on the one hand, and in an operatively interlocked fashion along the direction of displacement of the operating shaft, on the other hand. A holding member is arranged in opposed relation with the mounting unit with the variable output device interposed therebetween. An elasticity applier urges the operating unit away from the variable output device. The holding member is provided with an operating hole. The holding member is arranged at a position in opposed relation with the mounting unit with the variable output device and the operating unit interposed therebetween. The operating unit elastically urged by the elasticity applier is brought into contact with the peripheral edge portion of the operating hole of the holding member in opposed relation with the operating hole.

11 Claims, 9 Drawing Sheets

ANTI-MALFUNCTION MECHANISM FOR VARIABLE OUTPUT DEVICE

BACKGROUND OF THE INVENTION

1. Field of the Invention

The present invention relates to a mechanism for preventing the malfunction of a variable output device built in various electronic apparatuses.

2. Description of the Related Art

Conventional electric apparatuses are available which comprise a variable output device such as a variable resistor and an operating unit therefor. The operating unit is a knob for manipulating and therefore adjusting the variable output device from outside the apparatus.

FIG. 10 shows a mounting structure of a conventional operating unit 5. A variable output device 2 is connected by solder to a circuit board 1. The variable output device 2 has an operating shaft. The operating unit 5 is fitted on the operating shaft of the variable output device 2 to rotate integrally with the operating shaft. A part of the operating unit 5 is projected out of the electronic apparatus by way of a hole formed in an exterior case 7 of the electronic apparatus. The user adjusts the output of the variable output device 2 by rotating the operating unit 5 projected out of the apparatus. Various parameters of the electric apparatus are adjusted based on the output (amount of electricity, etc.) from the variable output device 2. A single-unit video camera recorder, for example, uses this type of a variable output device for adjusting the voice level to be recorded.

The conventional mounting structure of the variable output device is not provided with a lock mechanism for preventing malfunction. Under an incidental external force or with an inadvertent operation of the operating unit 5 by the user, the operating unit 5 is undesirably rotated against the will of the user, with the inconvenient result that the parameters of the electric apparatus are unduly changed.

In a single-unit video camera recorder, for example, a malfunction of the operating unit of a variable output device for adjusting the voice level may change the voice level against the intention of the user during the recording operation.

SUMMARY OF THE INVENTION

Accordingly, the primary object of this invention is to prevent the movement of the operating unit against the will of the user.

In order to achieve this object, according to this invention, there is provided an anti-malfunction mechanism for a variable output device having an operating shaft adapted to be displaced under an external force, whereby the output is changed in accordance with the displacement of the operating shaft.

The anti-malfunction mechanism according to the invention comprises a mounting unit on which the variable output device is mounted, an operating unit operated by the user to transmit the resulting external force to the operating shaft, a holding member arranged in opposed relation to the mounting unit with the variable output unit therebetween, and an elasticity applier for elastically urging the operating unit.

The variable output device is mounted on the mounting unit with the operating shaft displaceable. The operating unit is mounted on the operating shaft relatively movably along the direction of the axis of the operating shaft, on the one hand, and in an operatively interlocked fashion along the direction of displacement of the operating shaft, on the other hand. The operating unit is elastically urged in the direction away from the variable output unit by the elasticity applier. The holding member is provided with an operating hole and arranged in opposed relation to the mounting unit with the variable output device and the operating unit therebetween. The operating unit elastically urged by the elasticity applier is brought into contact with the peripheral edge portion of the operating hole of the holding member in opposed relation to the operating hole.

As a result, according to this invention, as long as the operating unit is not pressed along the axial direction by the user, the operating unit is kept elastically urged into contact with the peripheral edge portion of the operating hole of the holding member. During this period, the operating unit is pressed fixedly against the holding member and therefore not substantially displaced. As a result, the malfunction of the electricity regulator in off state can be positively prevented.

According to this invention, a buffer member is preferably interposed between the operating unit and the peripheral edge portion of the operating hole of the holding member. By doing so, the operating unit is fixed on the holding member more securely and becomes more difficult to displace. Also, the buffer member enables the gap between the operating hole and the operating unit to be hermetically sealed.

According to this invention, the configuration described below is preferably employed. Specifically, an elasticity applier seat for supporting the elasticity applier is arranged on the operating shaft relatively movably in the direction along the axis of the operating shaft, on the one hand, and in an operatively interlocked manner in the direction of displacement of the operating shaft, on the other hand. The operating unit is mounted on the elasticity applier seat relatively movably in the axial direction and in operatively interlocked manner in the direction of displacement of the operating shaft. By doing so, the elastic force generated by the elasticity applier fails to reach the variable output device directly. As a result, the variable output device is not easily broken and the durability is not adversely affected.

The elasticity applier is, for example, a coil spring or a corrugated washer.

According to this invention, the elasticity applier seat is provided. This elasticity applier seat, when formed of a coil spring, preferably has a cylinder surrounding the elasticity applier. By doing so, the expansion/contraction of the elasticity applier is guided smoothly by the cylinder. Further, a taper for preventing the elasticity applier from being caught is preferably formed at the corner of the cylinder contacted by the elasticity applier. Then, the elasticity applier, when expanding or contracting, is not caught and operates more smoothly.

According to this invention, the configuration described below is preferably employed. Specifically, the variable output device includes a case with the operating shaft projected from an end thereof, and a protective member covering the end portion of the operating shaft on the case side. The elasticity applier seat is kept in contact with the protective member. By doing so, the end portion of the operating shaft on the case side is protected by the protective member. As a result, even in the case where the elastic force is applied repeatedly to the end portion of the operating shaft on the case side by the elasticity applier, the particular portion is not easily damaged and the reduction in the durability of the variable output device can be suppressed accordingly.

According to this invention, preferably, a metal sheet is provided on the surface of the operating unit contacted by the elasticity applier, and the elasticity applier is brought into contact with the metal sheet. By doing so, the functions and effects described below are obtained. Generally, the elasticity applier is configured of a metal, such as a steel, member from the viewpoint of the durability of the elastic force and cost. The operating unit, on the other hand, is often configured of a resin to reduce both cost and weight. After repeated elastic operations of the elasticity applier in contact with the operating unit, therefore, the operating unit is damaged and the durability thereof may be reduced. The provision of the metal sheet on the surface of the operating unit contacted by the elasticity applier can prevent the damage to the operating unit. In this case, the whole operating unit is not required to be configured of a metal, but only the portion thereof in contact with the elasticity applier is provided with a metal sheet. In this way, the increase of both cost and weight of the operating unit can be minimized. Incidentally, the metal sheet can be built in the operating unit of a resin by integral molding.

This invention is suitably applicable to a variable output device with the operating shaft thereof displaced in the direction of rotation.

BRIEF DESCRIPTION OF THE DRAWINGS

The above and other objects are made apparent by the appended claims and the detailed description of embodiments taken in conjunction with the accompanying drawings, and it is further understood by those skilled in the art that various advantages not described herein may be recognized by embodying the invention without departing from the spirit and scope thereof.

DETAILED DESCRIPTION OF THE INVENTION

Preferred embodiments of the invention are described below with reference to the drawings.

First Embodiment

Figure 1:
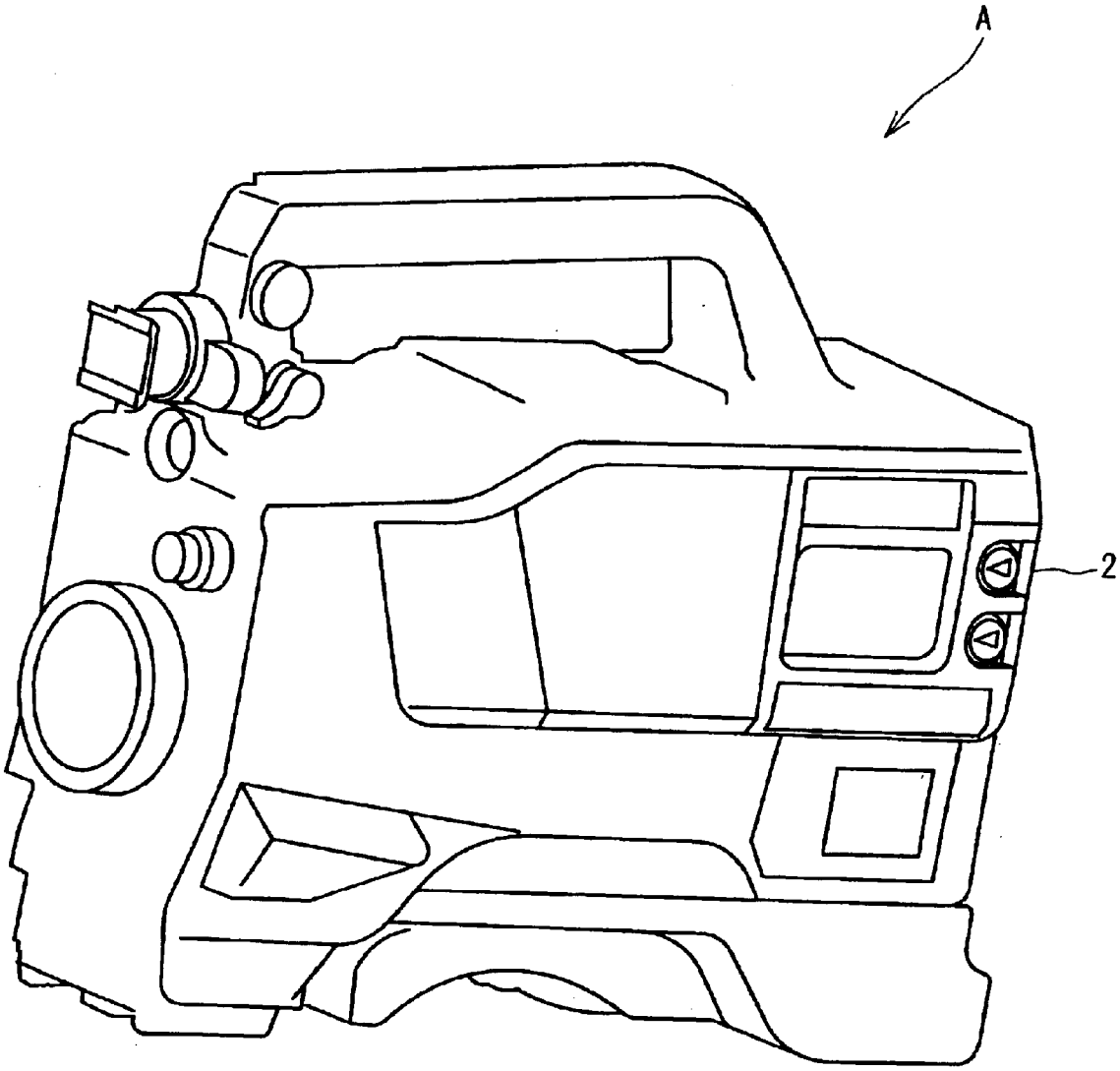
FIG. 1 is a perspective view showing an external appearance of a single-unit video tape recorder embodying the invention.
Figure 2:
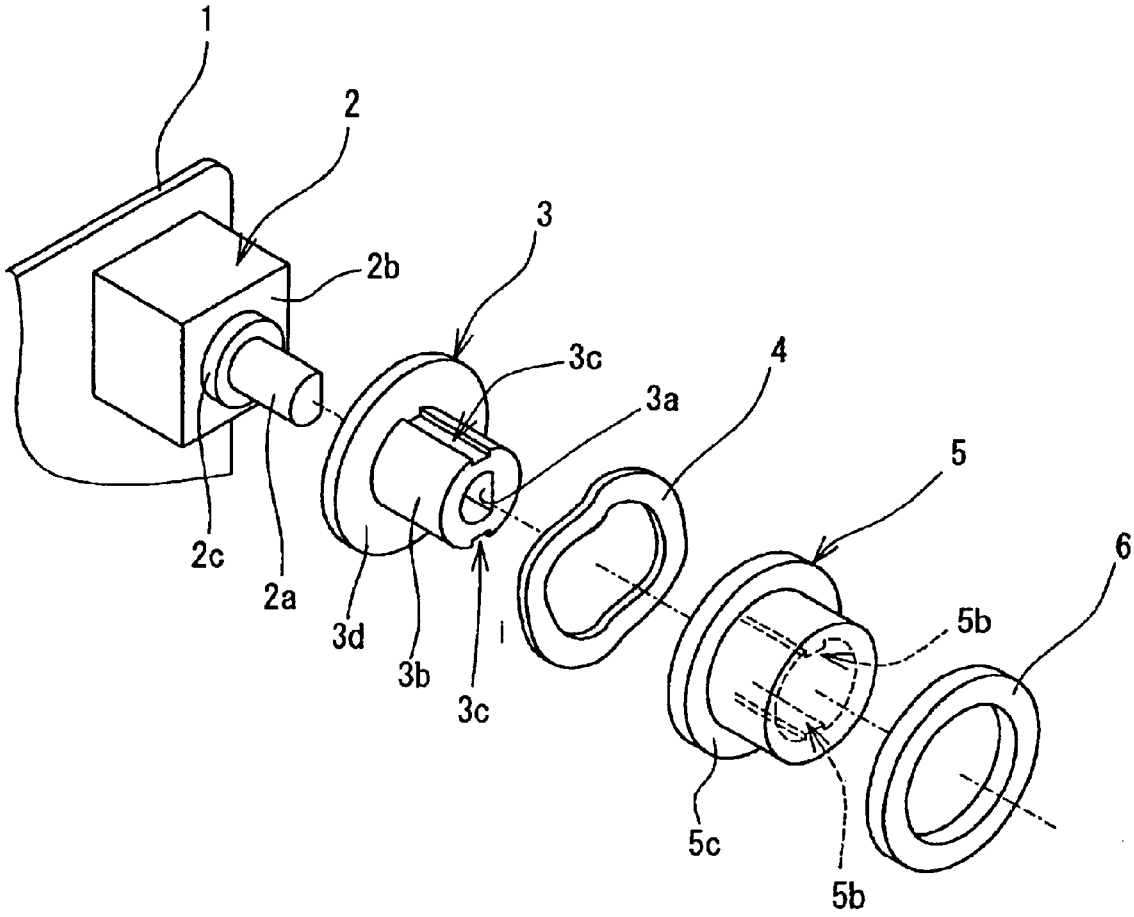
FIG. 2 is an exploded perspective view of an anti-malfunction mechanism for a variable output device according to a first preferred embodiment of the invention.
Figure 3:
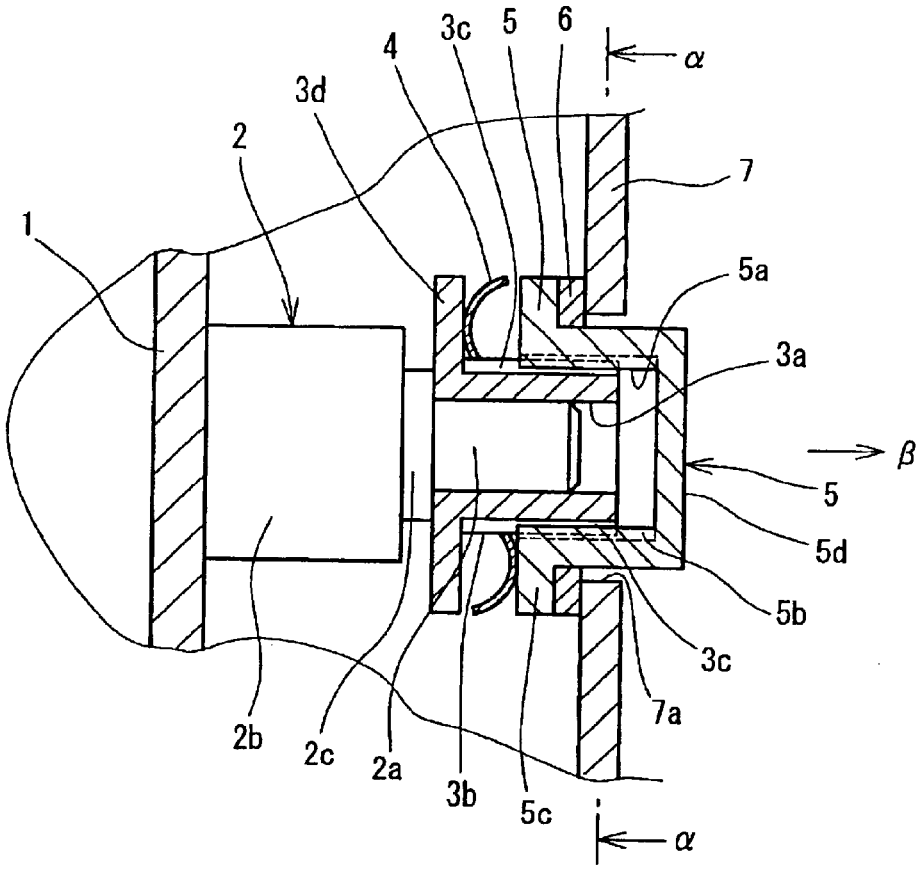
FIG. 3 is a sectional view showing the essential parts in enlarged form of the first preferred embodiment.
Figure 4:
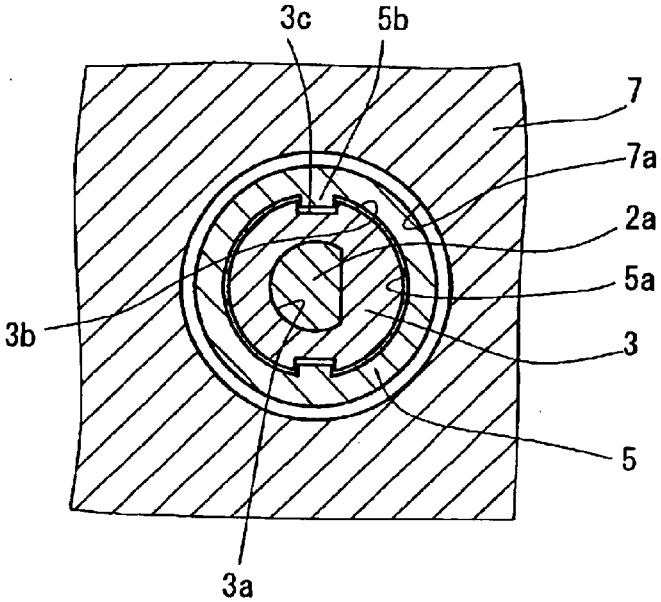
FIG. 4 is a sectional view taken along line α—α in FIG. 3.
Figure 5:
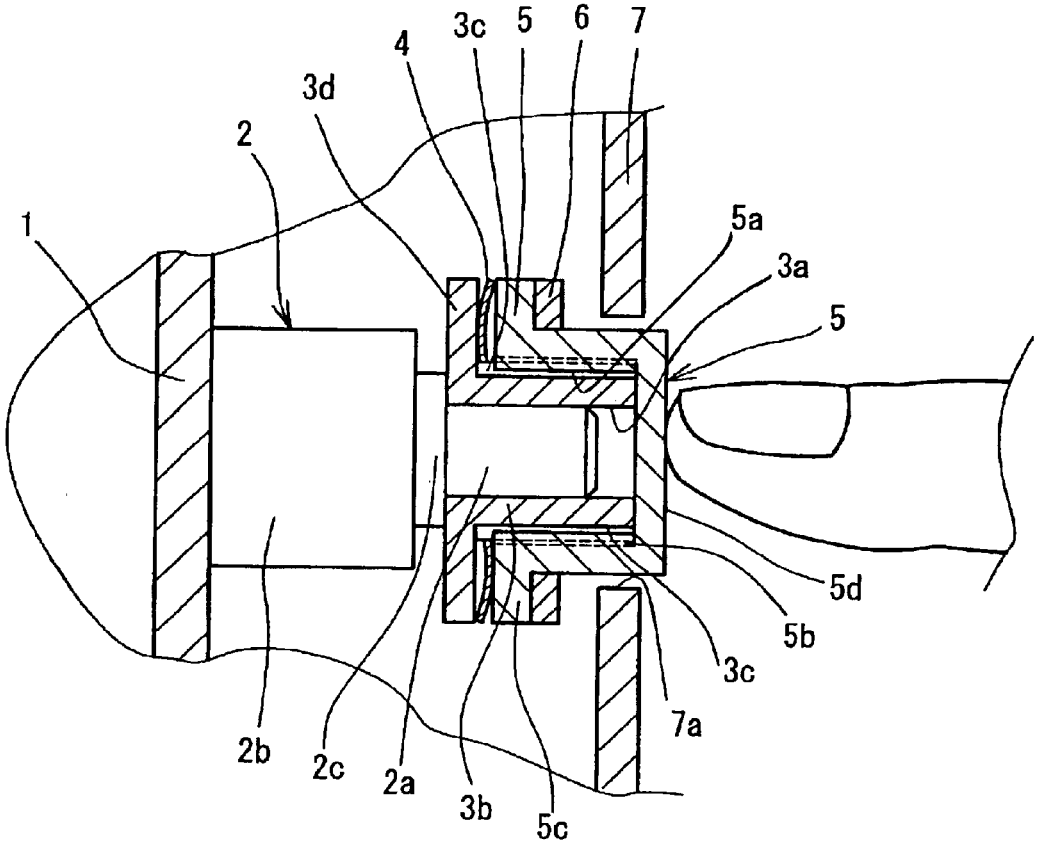
FIG. 5 is a sectional view showing essential parts, in enlarged form, kept under pressure according to the first embodiment.

FIG. 1 is a perspective view showing a general configuration of an electronic apparatus A having a built-in anti-malfunction mechanism for a variable output device according a first embodiment of the invention. FIG. 2 is an exploded perspective view showing the structure of an anti-malfunction mechanism for a variable output device according to the first embodiment of the invention. FIG. 3 is a sectional view showing the state in which a malfunction is prevented by the anti-malfunction mechanism for the variable output device according to the first embodiment. FIG. 4 is a sectional view taken along line α—α in FIG. 3. FIG. 5 is a sectional view showing the state in which the anti-malfunction mechanism for the variable output device according to the first embodiment is in operation.

The electronic apparatus A according to this embodiment is a single-unit video camera recorder. The electronic apparatus A includes a variable output device 2 for adjusting the voice level at the time of video recording. The variable output device 2 is configured of, for embodiment, a variable resistor, a variable capacitor and a rotary encoder.

The anti-malfunction mechanism according to this embodiment is a mechanism for preventing the malfunction of the variable output device 2 built in the electronic apparatus A. The variable output device 2 is built in as a circuit part of the electronic apparatus A. The variable output device 2 is mounted on a circuit board 1. The circuit board 1 is an embodiment of a mounting unit. In this embodiment the circuit board 1 is used as an example of a mounting unit. However, the mounting unit may be any other member on which the variable output device 2 can be mounted.

The circuit board 1 has mounted thereon various circuit parts including the variable output device 2 built in the electronic apparatus A. The variable output device 2 has an operating shaft 2*a*. The operating shaft 2*a* is rotated subject to a rotational operation by the user. The variable output device 2 produces an output (electrical resistance, capacitance, digital amount) changing in accordance with the rotational operation of the operating shaft 2*a* to an external device. The operating shaft 2*a* is projected outward of a case 2*b* of the variable output device 2. The operating shaft 2*a* is projected along the direction perpendicular to the surface of the circuit board 1. The operating shaft 2*a* has a flange 2*c*. The flange 2*c* is arranged in the vicinity of the surface of the case 2*b*. Due to the presence of the flange 2*c*, the operating shaft 2*a* assumes a shape having a stepped portion on the surface of the case 2*b*. The operating shaft 2*a*, though cylindrical, is cut away in an arcuate form along the axis thereof and has a D-shaped cross section.

An elasticity applier seat 3 is fitted coaxially on the operating shaft 2*a*. The elasticity applier seat 3 has an inner peripheral surface 3*a* in the same shape (D-shaped cross section) as the operating shaft 2*a*. The elasticity applier seat 3, with the inner peripheral surface 3*a* thereof fitted on the outer peripheral surface of the operating shaft 2*a*, is mounted on the operating shaft 2*a* in a manner rotatable integrally therewith. An outer peripheral surface 3*b* of the elasticity applier seat 3 is circumferential in shape. The outer peripheral surface 3*b* is formed with keyways 3*c*. The keyways 3*c* are formed along the axial direction on the outer peripheral surface 3*b*. The elasticity applier seat 3 has a flange 3*d*. The flange 3*d* is arranged at an end of the elasticity applier seat 3 on the case 2*b* side. The elasticity applier seat 3 is fitted on the operating shaft 2*a* with the flange 3*d* kept in contact with the flange 2*c*.

A cylindrical operating unit 5 is coaxially fitted on the elasticity applier seat 3. An inner peripheral surface 5*a* of the operating unit 5 has the same shape as the outer peripheral surface of the elasticity applier seat 3. The inner peripheral surface 5*a* is provided with key ridges 5*b*. The key ridges 5*b* are formed along the axial direction on the inner peripheral surface 5*a*. The key ridges 5*b* have a shape adapted to be fitted in the keyways 3*c*. As the key ridges 5*b* engage the keyways 3*b*, the operating unit 5 is fitted on the elasticity applier seat 3 in a manner rotatable integrally with the elasticity applier seat 3 and relatively movable along the axial direction.

The operating unit 5 has a flange 5*c*. The flange 5*c* is arranged on the bottom portion of the operating unit 5. The bottom portion of the operating unit 5 is located on the case 2*b* side.

A corrugated washer 4 is fitted on the elasticity applier seat 3. The corrugated washer 4 is located between the flange 3*d* and the flange 5*c*, and elastically urges the flanges 3*d* and 5*c* in the directions away from each other.

The flange 5*c* of the operating unit 5 is provided with a rubber ring 6. The rubber ring 6 is mounted on the surface of the flange 5*c* opposite to the corrugated washer 4 with the flange 5*c* interposed therebetween. The rubber ring 6 is configured of a rubber material such as chloroprene rubber (CR).

The exterior case 7 of the electronic apparatus A has an operating unit insertion hole 7*a*. The operating unit insertion hole 7*a* is formed in opposed relation with the variable output device 2. The operating unit insertion hole 7*a* has a diameter larger than the outer diameter of the operating unit 5 and smaller than the outer diameter of the flange 5*c*. According to this embodiment, the exterior case 7 makes up a holding member. The operating unit insertion hole 7*a* constitutes an operating hole.

The circuit board 1 is arranged at a position in proximity to the exterior case 7 in the direction parallel to the exterior case 7. The circuit board 1 is fixed on the exterior case 7 at the particular position. As the circuit board 1 is mounted this way, a top 5*d* of the operating unit 5 is projected from the exterior case 7. The operating unit 5 has the top 5*d* thereof projected out of the electronic apparatus through the operating unit insertion hole 7*a*, and arranged with the flange 5*c* in contact with the peripheral edge of the operating unit insertion hole 7*a*. In the process, the corrugated washer 4 urges the flange 5*c* toward the exterior case 7. As a result, the flange 5*c* is pressed against the portion of the exterior case 7 on the peripheral edge of the operating unit insertion hole 7*a*. The flange 5*c* is pressed against the peripheral edge of the operating unit insertion hole 7*a* through the rubber ring 6.

Next, the operation of the anti-malfunction mechanism for the variable output device according to this embodiment is explained. As long as the adjusting operation of the variable output device 2 is not performed by the user, the flange 5*c* of the operating unit 5 is pressed against the portion of the exterior case 7 making up the peripheral edge of the operating unit insertion hole 7*a* by the corrugated washer 4. In the process, the rubber ring 6 is interposed between the flange 5*c* and the peripheral edge of the operating unit insertion hole 7*a*. Under this condition, the corrugated washer 4 is elastically urged so that the operating unit 5 is pressed against the inner side surface of the exterior case 7 along the axial direction (direction β in FIG. 3) together with the rubber ring 6. As a result, the friction under pressure is generated between the flange 5*c* (rubber ring 6) and the peripheral edge of the operating unit insertion hole 7*a*. As a result, the operating unit 5 is fixed on the exterior case 7. Thus, the operating unit 5 is not easily rotated by an external force other than a substantial one. Also, since the gap between the operating unit 5 and the operating unit insertion hole 7*a* is hermetically sealed by the rubber ring 6, dust, water drips, etc. are kept away from the interior of the electronic apparatus A as long as the adjusting operation of the variable output device 2 is not performed.

In carrying out the adjusting operation of the variable output device 2, as shown in FIG. 5, the user pushes the operating unit 5 into the exterior case 7 against the resistance of the corrugated washer 4. This operation is enabled by the fact that the operating unit 5 is mounted on the elasticity applier seat 3 relatively movable therewith along the axial direction.

Once the operating unit 5 has been pushed in, a gap is formed between the surface of the rubber ring 6 and the peripheral edge of the operating unit insertion hole 7*a*. As a result, the operating unit 5 is unlocked. Under this condition, the user rotates the operating unit 5 while maintaining the pushed-in state. The operating unit 5 is mounted on the elasticity applier seat 3 to rotate integrally therewith. By rotating the operating unit 5, therefore, the elasticity applier seat 3 is also rotated in the same direction. The elasticity applier seat 3 is mounted on the operating shaft 2*a* to rotate integrally therewith. With the rotation of the elasticity applier seat 3, therefore, the operating shaft 2*a* is also rotated in the same direction. As a result, the output (electrical resistance, etc.) of the variable output device 2 undergoes a change.

Upon confirmation that the output of the variable output device 2 has changed by the desired amount, the user stops the operation of rotating and pressing the operating unit 5. Then, the flange 5*c* of the operating unit 5 elastically urged by the corrugated washer 4 is pressed against the peripheral edge of the operating unit insertion hole 7*a*. As a result, the operating unit 5 is fixed on the exterior case 7 and thus prevented from rotating. Also, the gap between the operating unit 5 and the operating unit insertion hole 7*a* is hermetically sealed.

Although an anti-malfunction mechanism for the operating unit of a rotary variable resistor has been explained above in this embodiment, the invention is also applicable to an operating unit of a sliding variable resistor. Specifically, a variable resistor with the resistance value thereof changed by a slide is used as a variable output device. The operating unit mounted on the slide operating shaft portion of the variable resistor makes up an operating unit similar to the one according to this embodiment. The exterior case is provided with a slot in which the operating unit slides.

With this configuration, the friction force generated by the elastically urged corrugated washer brings the operating unit into close contact with the exterior case, thereby preventing the slide operation. Also, the slide-type rotary variable resistor can be operated by sliding while pressing the operating unit.

Unlike the above-mentioned case in which a spring member is made up of the corrugated washer 4, the invention can be embodied also by use of a coil spring or other elastic member, such as rubber. Also, the invention can be embodied by using a sponge material instead of the rubber ring 6 for improved friction coefficient.

According to this embodiment, an inadvertent operation can be prevented in a simple and inexpensive fashion by use of a general-purpose variable resistor. The drip proofness and the dust proofness can also be improved.

Second Embodiment

Figure 6:
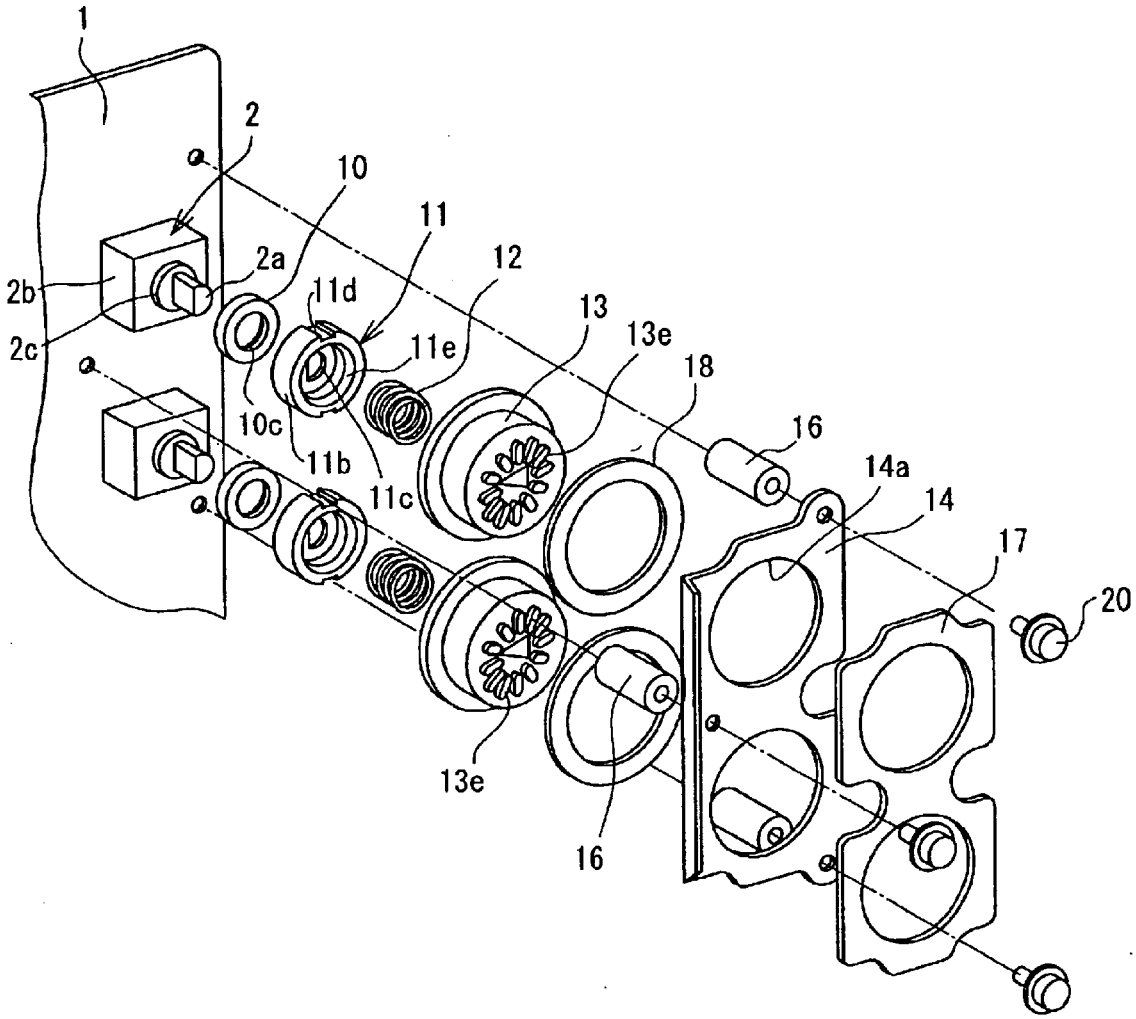
FIG. 6 is an exploded perspective view of an anti-malfunction mechanism for a variable output device according to a second embodiment of the invention.
Figure 7:
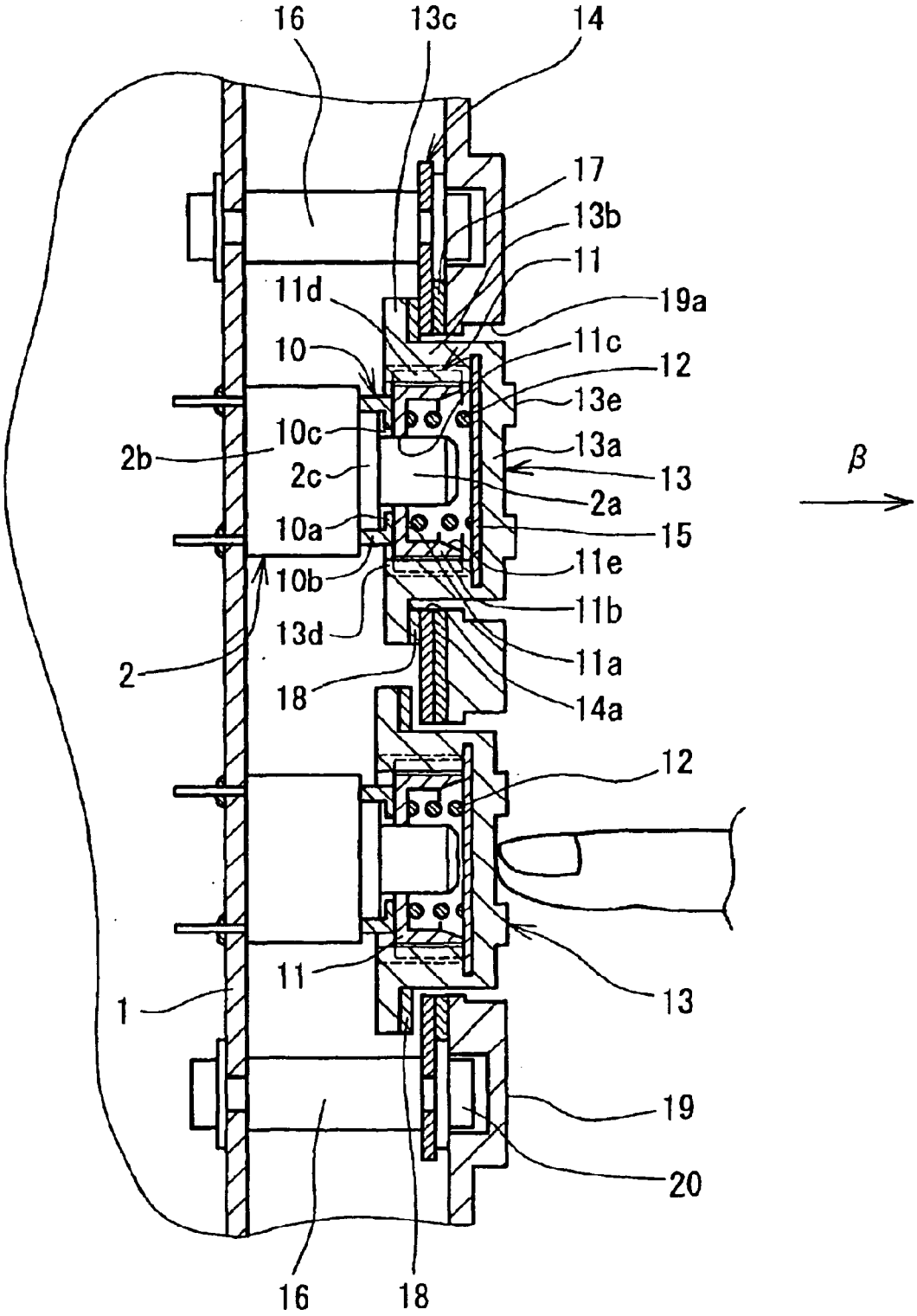
FIG. 7 is a sectional view showing essential parts in enlarged form of the second embodiment.

FIG. 6 is an exploded perspective view showing a structure of an anti-malfunction mechanism for a variable output device according to a second preferred embodiment of the invention. FIG. 7 is a sectional view showing a state in which the anti-malfunction mechanism for the variable output device according to the second embodiment shown in FIG. 7 works to prevent a malfunction.

The second embodiment basically has a similar configuration to the first embodiment. Therefore, in the second embodiment, those component parts similar or identical to the corresponding component parts of the first embodiment are designated by the same reference numerals.

Each variable output device 2 has an operating shaft 2*a*. The operating shaft 2*a* is projected out of the case 2*b* of the variable output device 2. Each operating shaft 2*a* is projected along the direction perpendicular to the surface of the circuit board 1. The operating shaft 2*a* has the flange 2*c*. The flange 2*c* is arranged in the vicinity of the surface of the case 2*b*. In view of the fact that the operating shaft 2*a* has the flange 2*c*, the surface portion of the case 2*b* is stepped. The operating shaft 2*a*, though cylindrical in shape, is cut away in an arcuate fashion along the axial direction and therefore has a D-shaped cross section.

The anti-malfunction mechanism for the variable output device, according to this embodiment, comprises protective members 10, spring bearing members 11, coil springs 12, operating units 13 and a holding plate 14.

Each protective member 10 includes a disk portion 10*a* and a short cylindrical portion 10*b*. The disk portion 10*a* is coupled to one end of the short cylindrical portion 10*b*. The disk portion 10*a* closes the end of the short cylindrical portion 10*b*. The size of the short cylindrical portion 10*b* is set in the manner described below. Specifically, the short cylindrical portion 10*b* has an inner diameter somewhat larger than the outer diameter of the flange 2*c* of the operating shaft 2*a*. The short cylindrical portion 10*b* has an axis about several mm longer than that portion of the flange 2*c* of the operating shaft 2*a* which is projected from the case 2*b*. The short cylindrical portion 10*b* has a shaft insertion hole 10*c*. The shaft insertion hole 10*c* is formed concentrically with the short cylindrical portion 10*b*. The shaft insertion hole 10*c* is sufficiently large to allow the operating shaft 2*a* to be inserted therethrough.

Each protective member 10 is arranged with the short cylindrical portion 10*b* thereof directed toward the flange 2*c*, and under this condition, the operating shaft 2*a* allows itself to be inserted through the shaft insertion hole 10*c*. As a result, the protective member 10 is mounted on the variable output device 2. The protective member 10 is brought into contact with the surface of the case 2*b* without contacting the flange 2*c* of the operating shaft 2*a*. In this way, the protective member 10 is mounted on the operating shaft 2*a*. Thus, the flange 2*c* of the operating shaft 2*a* is accommodated in the short cylindrical portion 10*b* and physically protected.

Each spring bearing member 11 includes a disk portion 11*a* and a short cylindrical portion 11*b*. The disk portion 11*a* is coupled to an end of the short cylindrical portion 11*b*. The disk portion 11*a* closes the end of the short cylindrical portion 10*b*.

The disk portion 11*a* has a shaft insertion hole 11*c*. The shaft insertion hole 11*c* is formed concentrically with the disk portion 11*a*. The shaft insertion hole 11*c* has the shape and size described below. Specifically, the shaft insertion hole 11*c* has such a shape and size that the spring bearing member 11 is movable relatively with respect to the operating shaft 2*a* along the axis of the operating shaft 2*a*, while the spring bearing member 11 rotates in operatively interlocked relation integrally with the operating shaft 2*a*.

The size of the short cylindrical portion 11*b* is set in the manner described below. Specifically, the short cylindrical portion 11*b* has a sufficient inner diameter to accommodate the coil spring 12. The short cylindrical portion 11*b* has an axis about several mm shorter than the axis of the coil spring 12. The short cylindrical portion 11*b* has a sufficient axial length to protect the coil spring 12 while at the same time securing the extension/contraction stroke thereof.

The outer peripheral surface of the short cylindrical portion 11*b* has a circumferential shape. The outer peripheral surface of the short cylindrical portion 11*b* has keyways 11*d*, which are formed along the axial direction of the short cylindrical portion 11*b*.

Each spring bearing member 11 is arranged with the disk portion 11*a* directed toward the protective member 10. Under this condition, the operating shaft 2*a* allows itself to be inserted through the shaft insertion hole 11*c*. As a result, the spring bearing member 11 is mounted on the variable output device 2.

The coil spring 12 has such a diameter as to allow the operating shaft 2*a* to be inserted through it on the one hand and allow itself to be accommodated in the short cylindrical portion 11*b* on the other hand. The coil spring 12, while being accommodated in the spring bearing member 11, is mounted on the outer periphery of the operating shaft 2*a*.

Each operating unit 13 includes a disk portion 13*a*, a short cylindrical portion 13*b* and a flange portion 13*c*. The disk portion 13*a* is coupled to an end of the short cylindrical portion 13*b*. The disk portion 13*a* closes one end of the short cylindrical portion 13*b*. The flange portion 13*c* is coupled to the other end of the short cylindrical portion 13*b*. The flange portion 13*c* is extended diametrically outward of the other end of the short cylindrical portion 13*b*.

The size of the short cylindrical portion 13*b* is set in the manner described below. Specifically, the short cylindrical portion 13*b* has an inner diameter sufficiently large to accommodate the spring bearing member 11. The short cylindrical portion 13*b* has an axial length substantially equal to that of the coil spring 12.

The inner peripheral surface of the short cylindrical portion 13*b* is provided with key ridges 13*d* along the axial direction. The key ridges 13*d* are formed along the axis of the short cylindrical portion 13*b*. The key ridges 13*d* have such a shape that they are fitted in the keyways 11*d*.

A metal sheet 15 is mounted on the surface of each disk portion 13*a* located on the bottom of the short cylindrical portion 13*b*. The metal sheet 15 is configured of a metal such as stainless steel, aluminum or copper. The metal sheet 15 is arranged along the disk portion 13*a*. The metal sheet 15 is molded integrally with the operating unit 13. The metal sheet 15 is exposed to the bottom of the short cylindrical portion 13*b*.

Each operating unit 13 is fitted on the spring bearing member 11 with the short cylindrical portion 13*b* thereof accommodating the coil spring 12, the spring bearing member 11 and the operating shaft 2*a*. In the process, the operating unit 13, with the key ridges 13*d* engaging the keyways 11*d*, is mounted relatively movably along the axis of the operating shaft 2*a* in a way adapted to rotate integrally with the spring bearing member 11. The coil spring 12 is in contact with the metal sheet 15.

The flange 13*c* of each operating unit 13 has a rubber ring 18. The rubber ring 18 is mounted on that surface of the flange 13*c* on the side of the short cylindrical portion 13*b*. The rubber ring 18 is composed of a rubber material such as chloroprene rubber (CR).

A holding plate 14 is sufficiently large to cover one or a plurality of variable output devices 2 mounted on the circuit board 1. The holding plate 14 has operating unit insertion holes 14*a*. The operating unit insertion holes 14*a* are formed at positions each in opposed relation with the corresponding variable output device 2. The operating unit insertion holes 14*a* each have a diameter larger than the outer diameter of the corresponding operating unit 13 and smaller than the outer diameter of the corresponding flange 13*c*. The operating unit insertion holes 14*a* constitute operating holes.

The holding plate 14 is fixed by fixing screws 20 on the circuit board 1 through supports 16. The holding plate 14, with the supports 16 interposed in the space with the circuit board 1, is mounted parallel to the circuit board 1 in spaced relation with the circuit board 1. The holding plate 14 is mounted on the circuit board 1 with the operating units 13 inserted in the operating unit insertion holes 14*a* and the flange portions 13*c* engaging the peripheral edge of the operating unit insertion holes 14*a*, respectively.

The operating units 13 are elastically urged toward the holding plate 14 by the coil springs 12. The flange portion 13*c* of each operating unit 13 thus elastically urged engages the peripheral edge of the corresponding operating unit insertion hole 14*a*, whereby the operating units 13 are supported between the holding plate 14 and the circuit board 1.

In the configuration according to this embodiment with the operating units 13 mounted as described above, the height of each support 16 is set in the manner described below. While being elastically urged by the coil springs 12, a small gap (about several mm) is required between the bottom of the disk portion 13*a* of each operating unit 13 and the short cylindrical portion 11*b* of the corresponding spring bearing member 11. This gap is required to accommodate the operating stroke of the operating units 13. The supports 16 have a sufficient height to form the particular gap.

The holding plate 14 has a drip-proof buffer member 17. The drip-proof buffer member 17 is arranged on that surface of the holding plate 14 which is on the far side from the circuit board. The drip-proof buffer member 17 is attached substantially over the entire surface described above.

The circuit board 1, on which the operating units 13, the coil springs 12, the spring bearing members 11 and the protective members 10 are mounted, is mounted on the inner surface of an exterior case 19 by the holding plate 14. The circuit board 1 is arranged substantially parallel to the inner surface of the exterior case 19 of the electric apparatus A. The exterior case 19 is provided with the operating unit insertion holes 19*a*. The operating unit insertion holes 19*a* are each formed at such a position as to be opposed to the corresponding operating unit 13 when the circuit board 1 is mounted on the exterior case 19. The circuit board 1 is mounted on the exterior case 19 with the top of each operating unit 13 projected out of the exterior case 19 through the corresponding operating unit insertion hole 19*a*. With the circuit board 1 mounted on the exterior case 19, the drip-proof buffer member 17 is in contact with the inner surface of the exterior case 19. As a result, the gap between the peripheral edge of each operating unit insertion hole 19*a* and the holding plate 14 is hermetically kept sealed off from the outside of the exterior case 19.

Next, the operation of the anti-malfunction mechanism for the variable output device according to this embodiment is explained. As long as the adjusting operation of the variable output device 2 is not performed by the user, the flange 13*c* of each operating unit 13 is pressed against the holding plate 14 at the peripheral edge of the corresponding operating unit insertion hole 14*a* by the corresponding coil spring 12. Under this condition, the operating units 13 are pressed against the inner side surface of the holding plate 14 along the axial direction (direction β in the drawing) together with the rubber rings 18 by the elastic force of the coil springs 12. As a result, pressure friction is generated between each flange 13*c* and the peripheral edge of the corresponding operating unit insertion hole 14*a*. The particular operating unit 13 thus is fixed on the holding plate 14 and is prevented from being rotated by an external force other than a substantial one.

In performing the adjusting operation of the variable output device 2, as shown in FIG. 7, the user pushes the operating units 13 into the exterior case 19 against the resistance of the coil springs 12. This operation is enabled by the fact that the operating units 13 are mounted relatively movably along the axial direction with respect to the spring bearing members 11, respectively. Once the operating units 13 are pushed in, a gap is generated between the surface of each rubber ring 18 and the peripheral edge of the corresponding operating unit insertion hole 14*a*. As a result, the operating units 13 are released from the fixed state. Under this condition, the user rotates the operating units 13 while maintaining the pushed-in state thereof. The operating units 13 are mounted to integrally rotate with the spring bearing members 11, respectively. With the rotation of the operating units 13, therefore, the spring bearing members 11 also rotate in the same direction. Each spring bearing member 11 is also mounted to rotate integrally with the operating shaft 2*a* associated therewith. With the rotation of a spring bearing member 11, therefore, the corresponding operating shaft 2*a* also rotates in the same direction. As a result, the output (electrical resistance, etc.) of the variable output device 2 undergoes a change.

Upon confirmation that the output of a variable output device 2 has changed by a desired amount, the user stops the operation of both rotating and pressing the corresponding operating unit 13. Then, the flange 13*c* of the operating unit 13 under the effect of the elasticity of the coil spring 12 is pressed against the peripheral edge of the corresponding operating unit insertion hole 14*a*. As a result, the particular operating unit 13 is fixed by the holding plate 14 and stops rotating.

According to this embodiment, the protective members 10, the spring bearing members 11, the coil springs 12 and the operating units 13 are fixed on the circuit board 1 by the holding plate 14, thereby assembling these component parts 10 to 13 on the circuit board 1. After the component parts 10 to 13 are assembled on the circuit board 1, the circuit board 1 is mounted on the exterior case 19.

The holding plate 14 for fixing the component members 10 to 13 on the circuit board 1 is comparatively small in size. Therefore, the job of assembling the component parts 10 to 13 on the circuit board 1 using the holding plate 14 is comparatively easy. Further, the circuit board 1 can also be mounted on the exterior case 19 with comparative ease as this job is carried out after assembling the component parts 10 to 13 on the circuit board 1. As described above, according to this embodiment, both the working efficiency for assembling the component parts 10 to 13 on the circuit board 1 and the working efficiency for mounting the circuit board 1 on the exterior case 19 are improved, and therefore the productivity of the apparatus is improved as a whole. Also, in view of the fact the component parts 10 to 13 are assembled integrally as a unit on the circuit board 1, the component parts 10 to 13 can be handled easily at the time of manufacture and repair.

As long as the operating knobs 13 are not manipulated, the gaps between the operating unit insertion holes 19*a* formed in the exterior case 19 and the operating units 13 are hermetically sealed by the drip-proof buffer member 17 and the rubber rings 18, respectively. Therefore, both dust and water drips are kept away from the interior of the exterior case 19.

The operating shaft 2*a* of each variable output device 2, together with the flange 2*c*, is protected physically by the corresponding protective member 10. Therefore, the spring bearing member 11 is brought into contact with only the protective member 10 without coming into contact with the operating shaft 2*a*. The force generated by pressing the operating unit 13 is transmitted to the case 2*b* of the variable output device 2 through the protective member 10 but not to the operating shaft 2*a*. The case 2*b*, which is configured of a material such as a metal having a comparatively high physical strength, is not easily damaged even under a sustained external force applied thereto by the press operation of the operating unit 13. For this reason, according to this embodiment, a high durability of the variable output device 2 can be maintained. Also, the configuration in which no external force is applied to the operating shaft 2*a* facilitates the load management of each variable output device 2.

Each coil spring 12 has a very high durability, and therefore is not substantially buckled even under a sustained application of pressure of about 4 kg thereto. The pressure of about 4 kg is an almost maximum load which the user may ever apply to the operating unit 13. In this embodiment, using the coil springs 12 as elastic members secures a high durability.

The metal sheet 15 is integrally formed in each of the operating units 13, and the coil spring 12 is supported by the metal sheet 15. Generally, each operating unit 13 is configured of a resin mold for its low manufacturing cost. In the case where the coil spring 12 is supported by this operating unit 13, the durability of the operating unit 13 may be adversely affected. To improve the durability, it can be considered that the operating units 13 are made of a metal. However, it inconveniently increases both the manufacturing cost and the apparatus weight. According to this embodiment, the use of the metal sheet 15 not only suppresses the increase of both the cost and weight of the apparatus, but also improves the durability of the operating units 13.

According to this embodiment with the coil springs 12 built in, the end portion of each coil spring 12 may be caught by the end corner of the corresponding short cylindrical portion 11*b* when pressed by the user, thereby giving rise to the chance of making it impossible to move the operating unit 5 smoothly. In view of this, according to this embodiment, a taper 11*e* is formed on the inner surface of the end portion of each short cylindrical portion 11*b*. As a result, the end portion of the coil spring 12 is hardly caught by the end corner of the short cylindrical portion 11*b*, thereby maintaining smooth movement of each operating unit 5.

To permit the user to smoothly rotate each operating unit 13, smooth relative rotation between each spring bearing member 11 and the corresponding protective member 10 is necessary. According to this embodiment, the lubricity of the protective member 10 is improved by subjecting each protective member 10 to the dry lube baking finish or fluoric resin coating. As a result, the spring bearing member 11 and the protective member 10 are rotated smoothly relative to each other.

The elastic force generated by each coil spring 12 is set in the manner described below. Specifically, in order to prevent the operating unit 13 from being unduly rotated, each rubber ring 18 is required to be pressed against the holding plate 14 under the load of 800 g by the coil spring 12. Taking the durability of the holding plate 14, the circuit board 1 and the exterior case 19 formed of resin or the like into consideration, on the other hand, the load imposed on the holding plate 14 by the coil springs 12 is required to be not more than 5 kg. According to this embodiment, this load is set to 2.2 kg taking the aforementioned loading range into account.

In this embodiment, a plurality of minuscule protrusions 13*e* are formed at the top of each operating unit 13 (the surface of each disk portion 13*a*) in order to assure the rotational operation of the operating unit 13 by the user.

In the first and second embodiments, the rubber rings 18 and 6, if kept in contact with the holding plate 14 or the exterior case 7 over a protracted period of time, may be closely attached to the holding plate 14 or the exterior case 7, respectively. The operating units 13 and 5, if pressed by the user under this condition, would come off from the exterior case 7 or the holding plate 14, as the case may be, abruptly instead of gradually. Then, a large operating sound would be inconveniently emitted at the time of separation.

The unintentional rotation of the operating units 13 and 5 can be prevented conveniently by mounting the rubber ring 18 on both the operating unit 13 and the holding plate 14, and the rubber ring 6 on both the operating unit 5 and the exterior case 7. In that case, however, the rubber rings 18 or 6 may be closely attached to each other and a large operating sound is liable to be generated at the time of separation.

In view of this, according to the first and second embodiments, the rubber rings 18 and 6 are mounted only on the operating units 13 and 5, respectively, but not on the holding plate 14 or the exterior case 7. As a result, the operating sound can be suppressed at the time of separation of the operating units 13 and 5 from the holding plate 14 or the exterior case 7, respectively, while at the same time positively preventing the unintentional rotation of the operating units 13 and 5.

Especially in the case where the holding plate 14 is made of a metal in the second embodiment, the rubber ring 18 is preferably mounted on the operating unit 13. This is because the rubber ring 18 can generate a larger friction force in contact with a metal plate than in contact with a resin. The provision of the rubber ring 18 on the operating unit 13 generates a large friction force by contacting the holding plate 14 of a metal. The rubber ring 18, if mounted on the holding plate 14, on the other hand, comes into contact with the operating unit 13 made of a resin, and therefore cannot generate a large friction force. From the viewpoint of a lower manufacturing cost and a smaller weight, it is common practice to form the operating unit 13 of resin.

In order to suppress the operating sound further, the first and second embodiments employ CR for the rubber rings 6 and 18, respectively. The CR has a properly rough surface, and therefore the rubber rings 18 and 6 are not easily attached closely to the holding plate 14 or the exterior case 7, respectively. As a result, the operating sound is emitted less often at the time of separation of the rubber ring 18 and 6. To make it more difficult for the rubber rings 18 and 6 to closely attach to the holding plate 14 or the exterior case 7, the surface of the rubber rings 18 and 6 is preferably embossed.

Figure 8:
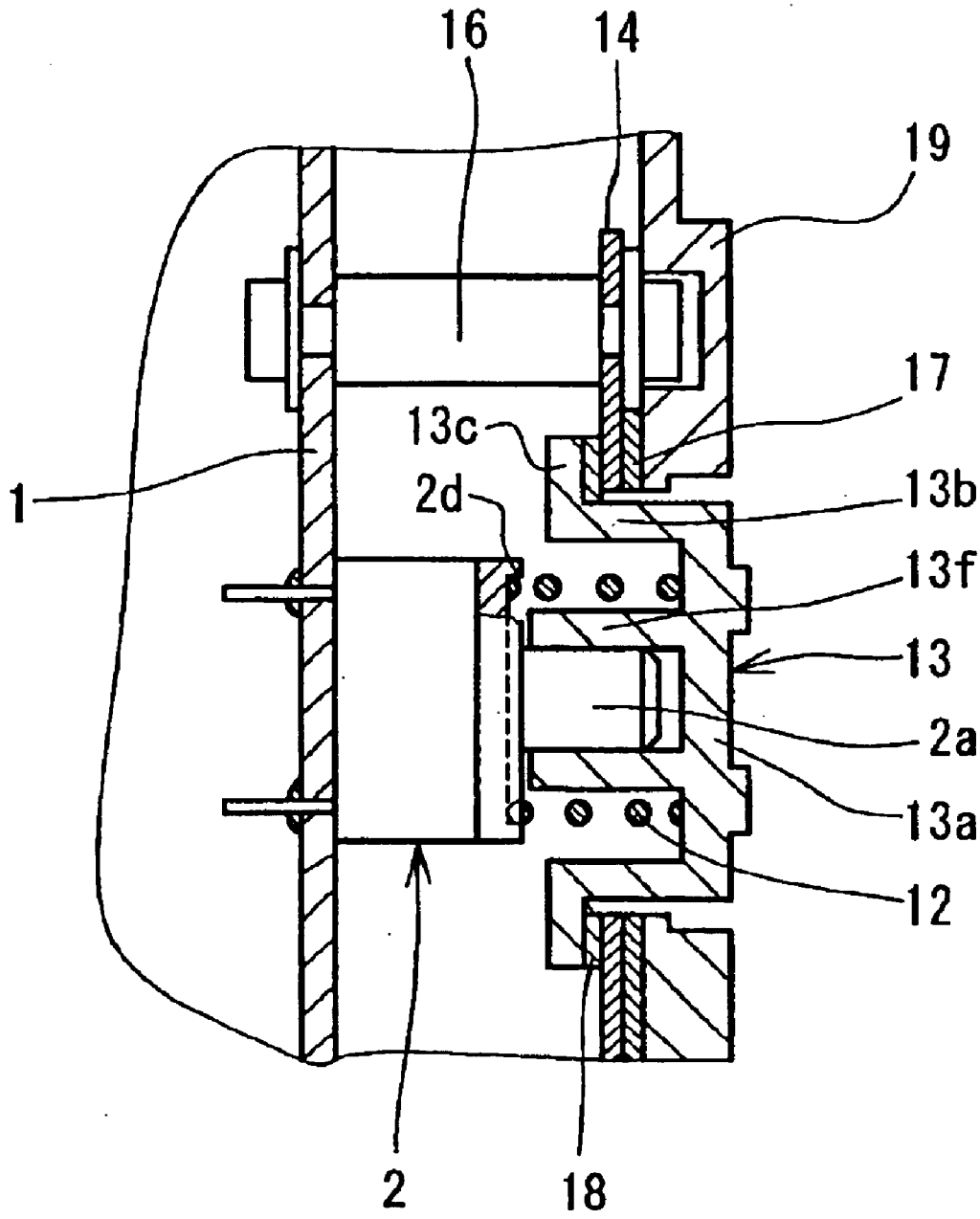
FIG. 8 is a sectional view showing, in enlarged form, essential parts according to a modification of the invention.

A modification of the second embodiment is shown in FIG. 8. This modification employs a coil spring 12 and has a basic configuration similar to that of the second embodiment described above. In the other modifications explained below with reference to FIG. 8, therefore, the component parts having a similar configuration are designated by the same reference numerals, respectively, and are not explained. In this modification, the spring bearing member 11 is done without, and, as an alternative, a shaft mounting cylinder 13*f* is provided on the operating unit 13. The shaft mounting cylinder 13*f* is arranged concentrically in the short cylindrical portion 13*b*. The shaft mounting cylinder 13*f* is formed integrally with the disk portion 13*a*. The inner peripheral surface of the shaft mounting cylinder 13*f* has the same shape as the outer peripheral surface of the operating shaft 2*a*. As a result, the shaft mounting cylinder 13*f* can be moved relative to the operating shaft 2*a* along the axis thereof, and both can rotate integrally with each other. This configuration also can produce a similar effect to the second embodiment. The shaft mounting cylinder 13*f* is formed integrally with the disk portion 13*a* as shown in FIG. 8. In the configuration shown in FIG. 9, however, a shaft mounting cylinder 13*f'* is alternatively formed as an entity independent of the disk portion 13*a*, and then bonded to rotate integrally with the disk portion 13*a*. Any one of these two configurations may be employed with equal effect.

Figure 9:
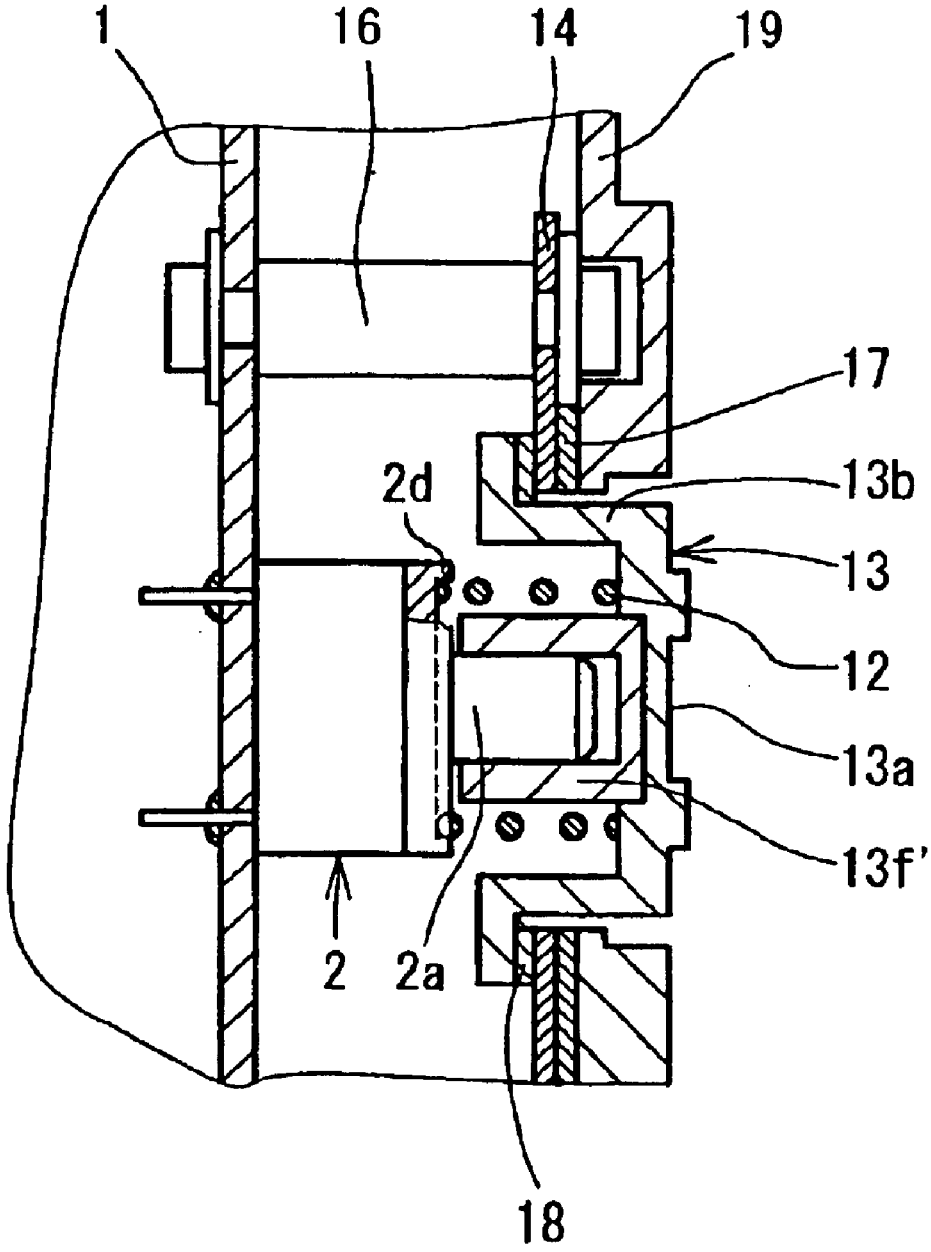
FIG. 9 is a sectional view showing, in enlarged form, essential parts according to another modification of the invention.
Figure 10:
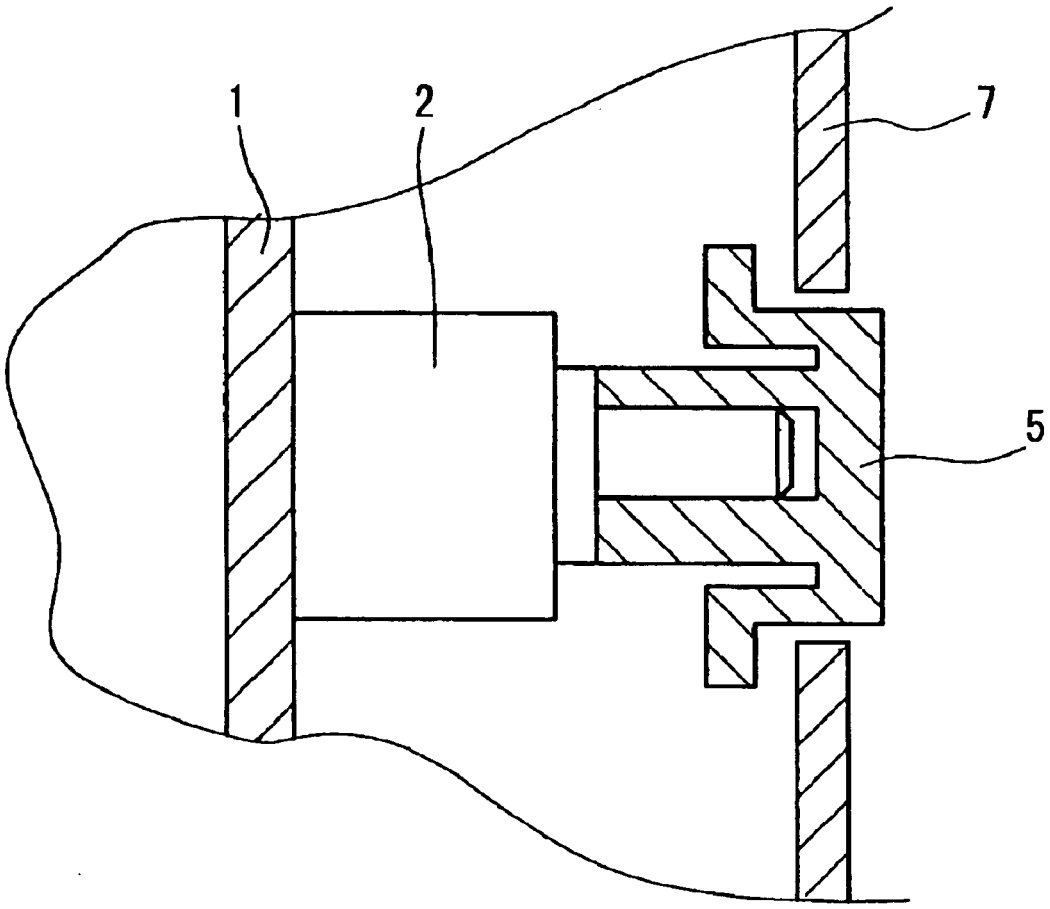
FIG. 10 PRIOR ART
FIG. 10 is a sectional view showing essential parts in enlarged form according to the prior art.

In FIGS. 8 and 9, reference numeral 2*d* represents a projected edge. The projected edge 2*d* is provided along the outer periphery of the coil spring contacting surface of the case 2*b*. The projected edge 2*d* is projected outward from the coil spring contacting surface in the axial direction of the operating shaft 2*a* to prevent the coil spring 12 from coming off from the case 2*b*.

The preferred embodiments of the invention have been described in detail above. Nevertheless, the combination and arrangement of the component parts, according to the preferred embodiments of the invention, are variously modifiable without departing from the spirit and scope of the invention set forth in the appended claims.

What is claimed is:

1. An anti-malfunction mechanism for at least a variable output device having an operating shaft adapted to be displaced under an external force and changing the output in accordance with the displacement of the operating shaft, the mechanism comprising:

a mounting unit for mounting the variable output device thereon;

at least an operating unit for receiving an operation of the user and transmitting the operation as the external force to the operating shaft;

a holding member arranged in opposed relation with the mounting unit with the variable output device interposed therebetween; and an elasticity applier for elastically urging the operating unit;

wherein the variable output device is mounted on the mounting unit with the operating shaft displaceable;

wherein the operating unit is mounted on the operating shaft relatively movably along direction of the axis of the operating shaft, on the one hand, and in an operatively interlocked fashion along the direction of displacement of the operating shaft, on the other hand;

wherein the operating unit is urged elastically by the elasticity applier in the direction away from the variable output device;

wherein the holding member is provided with an operating hole, the holding member being arranged at a position in opposed relation with the mounting unit with the variable output device and the operating unit interposed therebetween; and wherein the operating unit elastically urged by the elasticity applier is brought into contact with the peripheral edge portion of the operating hole of the holding member in opposed relation with the operating hole.

2. An anti-malfunction mechanism for at least a variable output device as claimed in claim 1, wherein a buffer member is interposed between the operating unit and the peripheral edge portion of the operating hole of the holding member.

3. An anti-malfunction mechanism for at least a variable output device as claimed in claim 1, wherein the operating shaft has mounted thereon an elasticity applier seat relatively movably along the direction of the axis of the operating shaft on the one hand and in an operatively interlocked fashion along the direction of displacement of the operating shaft on the other hand, the elasticity applier seat supporting the elasticity applier, and wherein the operating unit is mounted on the elasticity applier seat relatively movably along the direction of the axis of the operating shaft, on the one hand, and in the operatively interlocked fashion along the direction of displacement of the operating shaft, on the other hand.

4. An anti-malfunction mechanism for at least a variable output device as claimed in claim 3, wherein the elasticity applier is a coil spring and the elasticity applier seat has a cylinder surrounding the elasticity applier.

5. An anti-malfunction mechanism for at least a variable output device as claimed in claim 4, wherein a taper for preventing the elasticity applier from being caught is formed at each corner of the cylinder contacted by the elasticity applier.

6. An anti-malfunction mechanism for at least a variable output device as claimed in claim 1, wherein the elasticity applier is a coil spring.

7. An anti-malfunction mechanism for at least a variable output device as claimed in claim 1, wherein the elasticity applier is a corrugated washer.

8. An anti-malfunction mechanism for at least a variable output device as claimed in claim 1, wherein the variable output device includes a case with the operating shaft projected from an end thereof and a protective member for covering the end portion of the operating shaft on the case side, and wherein the elasticity applier seat is brought into contact with the protective member.

9. An anti-malfunction mechanism for at least a variable output device as claimed in claim 1, wherein a metal sheet is provided on the surface of the operating unit in contact with the elasticity applier, and the elasticity applier is brought into contact with the metal sheet.

10. An anti-malfunction mechanism for at least a variable output device as claimed in claim 1, wherein the operating shaft is displaced in the rotational direction.

11. A single-unit video camera recorder comprising at least a variable output device having an operating shaft adapted to be displaced under an external force and changing the output in accordance with the displacement of the operating shaft, and an anti-malfunction mechanism for the variable output device, the mechanism including:

a mounting unit for mounting the variable output device thereon;

at least an operating unit for receiving an operation by the user and transmitting the operation as the external force to the operating shaft;

a holding member arranged in opposed relation with the mounting unit with the variable output device interposed therebetween; and at least an elasticity applier for elastically urging the operating unit;

wherein the variable output device is mounted on the mounting unit with the operating shaft displaceable;

wherein the operating unit is mounted on the operating shaft relatively movably along the direction of the axis of the operating shaft, on the one hand, and in an operatively interlocked fashion along the direction of displacement of the operating shaft, on the other hand;

wherein the operating unit is urged elastically by the elasticity applier in the direction away from the variable output device;

wherein the holding member is provided with an operating hole, the holding member being arranged at a position in opposed relation with the mounting unit with the variable output device and the operating unit interposed therebetween; and wherein the operating unit elastically urged by the elasticity applier is brought into contact with the peripheral edge portion of the operating hole of the holding member in opposed relation with the operating hole.

* * * * *